US005285720A

United States Patent [19]

Wright

[11] Patent Number: 5,285,720

[45] Date of Patent: Feb. 15, 1994

[54] APPARATUS AND METHOD OF MANUFACTURING WOOD TRUSSES

[76] Inventor: Ronnie F. Wright, 2001 Haltom Rd., Fort Worth, Tex. 76111

[21] Appl. No.: 955,821

[22] Filed: Oct. 2, 1992

[51] Int. Cl.[5] ..... B30B 13/00; B30B 9/00

[52] U.S. Cl. ..... 100/35; 29/432; 29/798; 29/DIG. 46; 100/70 R; 100/913; 227/152

[58] Field of Search ..... 100/35, 70 R, 913; 29/432, 798, 821, DIG. 46; 227/152

[56] References Cited

U.S. PATENT DOCUMENTS

| | | | |
|---|---|---|---|
| 2,326,603 | 8/1943 | Barish | 29/DIG. 46 X |
| 2,563,479 | 8/1951 | Miles | 29/DIG. 46 X |
| 3,212,694 | 10/1965 | Sanford | 227/152 |
| 3,603,197 | 9/1971 | Wood . | |
| 3,785,277 | 1/1974 | Schmitt | 100/913 X |
| 3,908,885 | 9/1975 | Scott | 100/913 X |

FOREIGN PATENT DOCUMENTS

| | | | |
|---|---|---|---|
| 1072918 | 1/1960 | Fed. Rep. of Germany | 100/70 R |
| 1087440 | 8/1954 | France | 29/DIG. 46 |

OTHER PUBLICATIONS

Product Brochure-Fabrication & Cutting Equipment for Truss Manufacturing, MiTek Industries Group of Companies, 1988.

Product Brochure-Mark-V Fully Automatic Moving Press System, MiTek Industries, Inc., 1988.

Product Brochure-Floor Roller Ultra High-Speed Floor Truss Machine, MiTek Industries, Inc., 1988.

Product Brochure-Gantry For large trusses and long production runs, MiTek Industries, Inc., 1991.

Product Brochure-Mark-8 Mono-Press Truss Fabrication Equipment, MiTek Industries, Inc., 1988.

*Primary Examiner*—Stephen F. Gerrity

*Attorney, Agent, or Firm*—Crutsinger & Booth

[57] ABSTRACT

Disclosed is an improved apparatus and method of manufacturing wood trusses which utilizes an apparatus and method incorporating the use of a vibrator and the application of vibration forces during the process of seating connector plates in the wood cord members of the truss.

2 Claims, 7 Drawing Sheets

APPARATUS AND METHOD OF MANUFACTURING WOOD TRUSSES

TECHNICAL FIELD

The present invention relates to apparatus for fabricating structural components. More particularly, this invention concerns improvement in apparatus for constructing wooden members into trusses.

BACKGROUND OF THE INVENTION

Prefabricated truss rafters and floor supports are in wide use. Such trusses are typically assembled from wooden members positioned in an abutting relationship and joined together by connector plates. For example, the 1965 U.S. Patent to Sanford, U.S. Pat. No. 3,212,694 describes and illustrates triangular roof-type trusses being formed in this manner. The 1974 U.S. Patent to Schmitt, U.S. Pat. No. 3,785,277 shows flat, floor-type trusses formed in this manner. A typical connector plate for use in forming trusses is shown in the 1971 U.S. Patent to Wood, U.S. Pat. No. 3,603,197. As used herein, the term "connector plate" is used in a broad generic sense and is intended to mean a plate with protrusions which can be imbedded in the wood. The term is intended to include both unitary and non-unitary plates. It is only important that the plate have a sufficient dimension to span the distance between the two joined sections of wood and be used with protrusions embedded in the wood to form the connection. Connector plates include, for example, gang-nail plates and truss plates. In some connector plates a plurality of flat pointed protrusions are integrally joined with the plate. In the Wood patent the protrusions that are struck from the surface have slight curve to add rigidity to the protrusions.

Wooden cord members are properly positioned and connector plates are pressed or forced into the wood to join the cord members together to form a truss. Impact or hammer forces have not been used because these forces tended to cause the protrusions to fail in bending during assembly. In the past the proper seating of connector plates by pressing has encountered difficulty because of the massive forces required to embed or seat the protrusions in the wood. The problem is increased as truss and connector plate size and capacity are increased.

SUMMARY OF THE INVENTION

The invention contemplates a new method and apparatus for embedding connector plates in the wooden cords to assemble trusses. Surprisingly it has been found that by applying vibration forces during seating of the plate it is easier to form a better truss. This was surprising because it was anticipated that application of these forces to truss connector plates would reduce rather than increase the quality of the truss. It was expected that the protrusions would wallow out or enlarge the hole in the wood because of the vibrating forces, thus weakening the connection. However, I have found this is not the case.

The way in which a truss is improved by the application of vibration force during the installation of the connector plates is not completely understood. It is suspected that these forces cause the wood to instantaneously open up by reason of the vibration induced reciprocal impact or shock and cause the plate to seat more firmly in the wood, increasing the plate's strength.

It has also been found that the present invention allows the truss connector plates to be installed more efficiently by the use of less compressive force. It is believed that the present invention reduces the cutting of the wood fibers as the protrusions engage and are seated in the cords. In other words, the vibratory action reduces the time and force required to properly seat a truss connector plate. The rate of plate rejection is also reduced. In addition, it is believed that the vibratory forces reduce friction, stress and strain in the connector plate seating apparatus.

BRIEF DESCRIPTION OF THE DRAWINGS

These and other advantages and features of the present invention will be explained by reference to specific embodiments of the present invention as described and illustrated by reference to the attached drawings in which.

DETAILED DESCRIPTION

Figure 1:
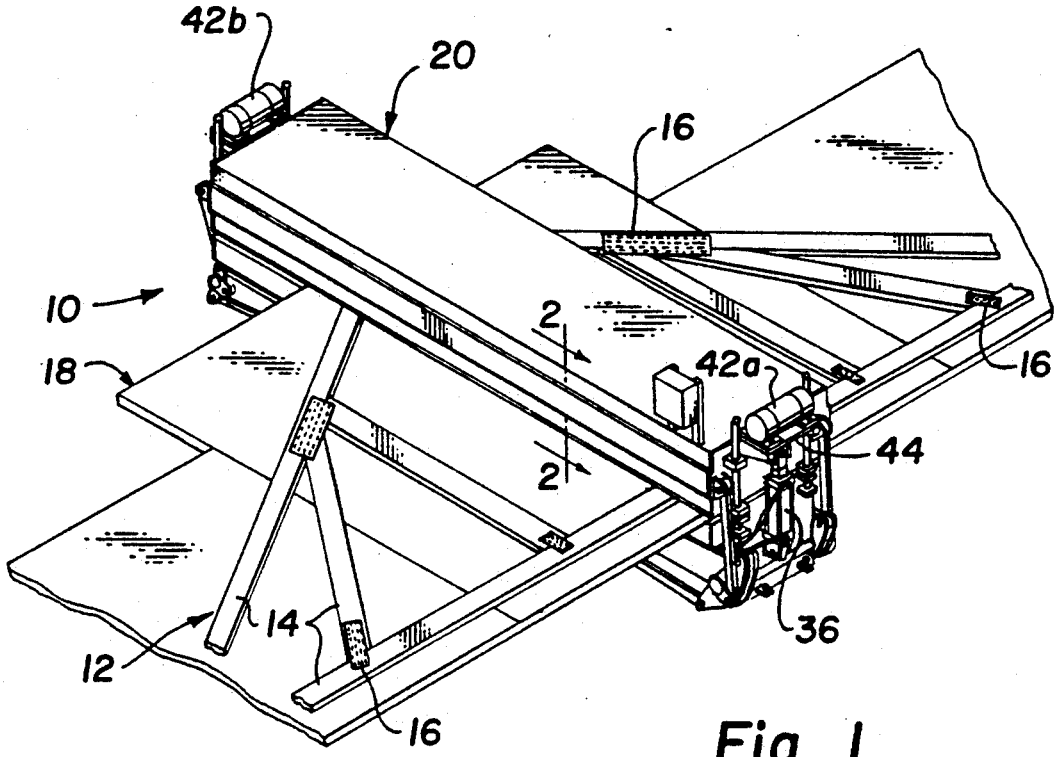
FIG. 1 is a perspective view of one embodiment of the improved wood truss manufacturing apparatus of the present invention.

The invention will be described by referring to various embodiments or forms of apparatus and methods incorporating the invention shown in the attached drawings. In these drawings reference characters are used throughout the several views to indicate like or corresponding parts. In FIG. 1, one embodiment of an apparatus 10 for use in forming or manufacturing trusses is shown. The details of the apparatus 10 are illustrated in FIGS. 1, 2 and 5–7. In these figures a truss assembly 12 is shown being formed from a plurality of wooden cords 14 and integrally formed connector plates 16. The present invention has application to all kinds of trusses. For purposes of description, a roof truss is shown with regard to apparatus 10. It is to be appreciated that trusses of various shares and types can be formed using the present invention. In addition, the connector plates 16 are illustrated as being of the type with the protrusions integrally formed. It is to be appreciated that the present invention has application with other types and shapes of connector plates.

The apparatus 10 has a support table 18. Table 18 is suitably supported above the ground by conventional means not shown. The table 18 provides a large flat surface on which the wooden members 14 of a truss can be laid out during the assembly process. Table 18 extends through a connector plate seating apparatus 20. The term "connector plate seating apparatus" is used herein in a broad generic sense to indicate any means for using force to seat protrusions in the wooden cord during manufacture of the truss. The connector plate seating apparatus can include moving and stationary presses, plate and roller presses, and any other apparatus utilized to force the protrusions into the wooden cord member.

Figure 3:
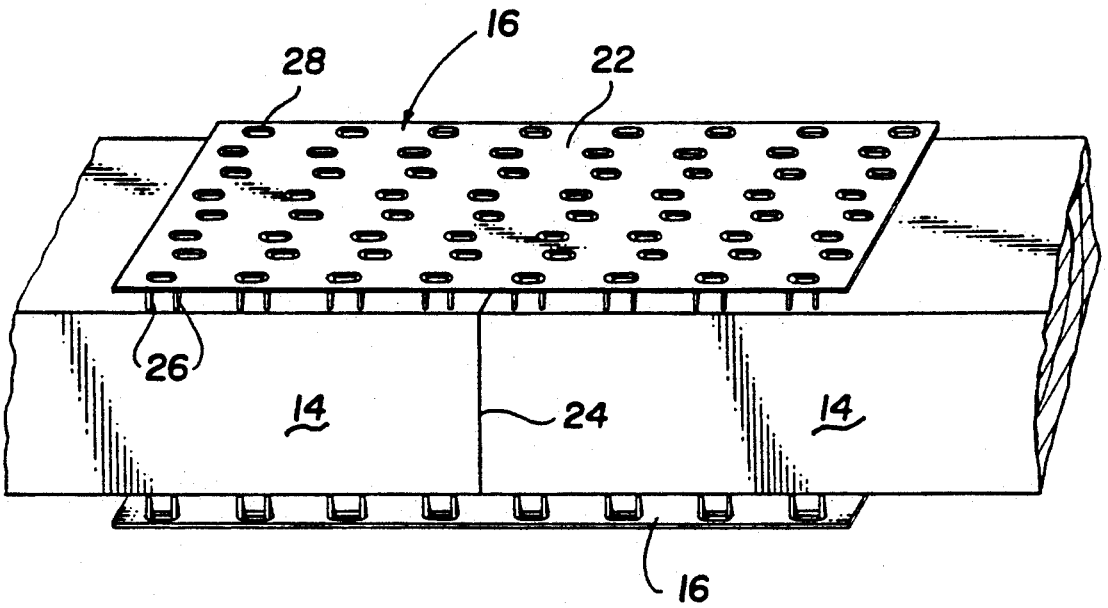
FIG. 3 is an enlarged view of connector plates shown in position on wooden cord members prior to installation.
Figure 4A:
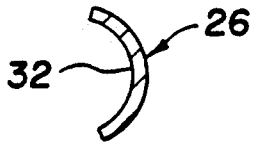
FIG. 4A is a sectional view taken on line 4A—4A of FIG. 4 looking in the direction of the arrows.
Figure 4:
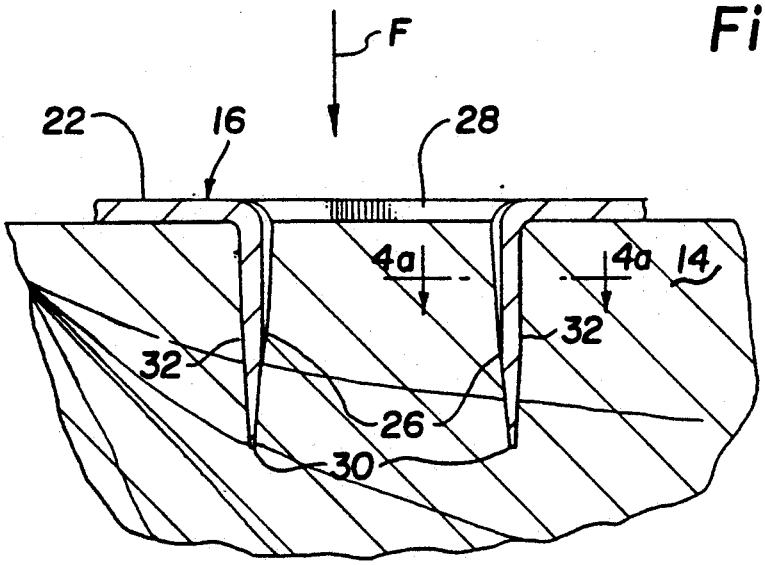
FIG. 4 is an enlarged sectional view of a portion of connector plate installed in a wooden cord.

Turning briefly to FIGS. 3, 4, and 4A it can be seen that the connector plate selected for purposes of illustrating the present invention comprises a plate-like body 22 of a sufficient dimension to span a joint 24 formed between two abutting wooden cord members 14. The connector plate is typically formed from metallic (steel) material in thickness typically in the range of 12 to 20 gauge. The physical size of the connector plate varies from application to application. A plurality of protrusions 26 are utilized to join the connector plate body 22 to the two cords 14 as is shown in FIG. 3. For purposes of the enabling details of how these plates are formed and the details of their construction the Wood patent previously referred to is incorporated herein by reference as an example of one type of connector plate. For purposes of general description it is to be noted that protrusions 26 are integrally formed by being struck or punched from the body 22 of the connector plate. A plurality of openings 28 in the body 22 are formed during this process. As is shown in detail in FIG. 4, each protrusion 26 is positioned to extend at right angles to the surface of the body 22. Typically, the protrusions 26 have pointed ends 30 to assist in penetrating the cord members 14. Protrusions 26 can be formed so that they are flat (planar) or can be curved to form an arcuate body 32 to improve the rigidity or stiff thereof. This curved body is shown in FIG. 4A. In a 5"×10" connector plate, approximately four hundred protrusions 26 will be present. The protrusions 26 are driven into the wood body of the cord members 14 by application of a force as shown by the arrow "F" in FIG. 4. These protrusions 26 act as nails or fasteners to join plates 16 to cords 14. As can be appreciated, massive forces measured in as much as hundreds of tons are required to properly seat the connector plate 16 in the cords 14. These forces are caused by the density of the wood, the size of the connector plate, the presence of a large number of protrusions 26, the thickness of the material from which the plate is formed, and the arcuate curved cross-section 32.

Figure 2:
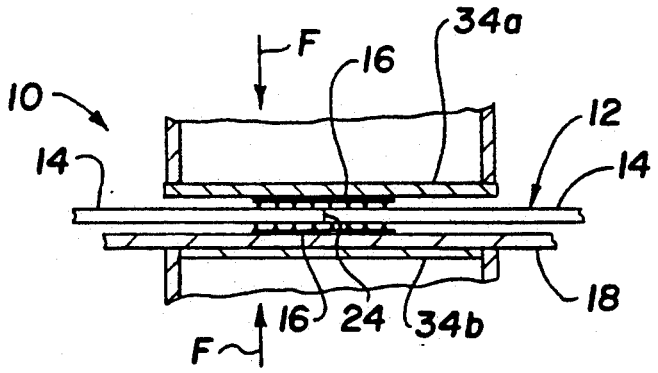
FIG. 2 is a sectional view taken on line 2—2 of FIG. 1, looking the direction of the arrows.

One embodiment of a connector plate seating apparatus 20 of the present invention is shown in FIG. 1. The apparatus 20 shown in FIG. 1 is of a stationary press type. In the apparatus 20 the cord 14 of truss 12 is properly positioned in adjacent relationship on table 18 (as shown). Two press plates 34A and B are used to force the connector plates 16 into the cords 14. The press plates 34A and B are shown in FIG. 2 with the truss 12 positioned therebetween. The truss 12 is shown with a connector plate 16 positioned on either side of the joint 24. Press plates 34A and B are forcibly moved to compress support table 18 connector plates 16 and cords 14. The compressive forces are illustrated in FIG. 2 by arrows "F". These forces are utilized to press the protrusions 26 of the connector plate 16 into the wooden cords 34 during seating of the connector plates. During manufacture of truss 12 the table 18 is moved in the forward and reverse direction of arrow "A" to position selected portions of the truss 12 between the two press plates 34A and B. As the press plates 34 are positioned over and below connector plates 16 the press plates are operated to close and forcibly seat the connector plate. The press plates are then retracted and the table moves the truss to the next position where another connector plate is pressed or seated in the wood.

Figure 5:
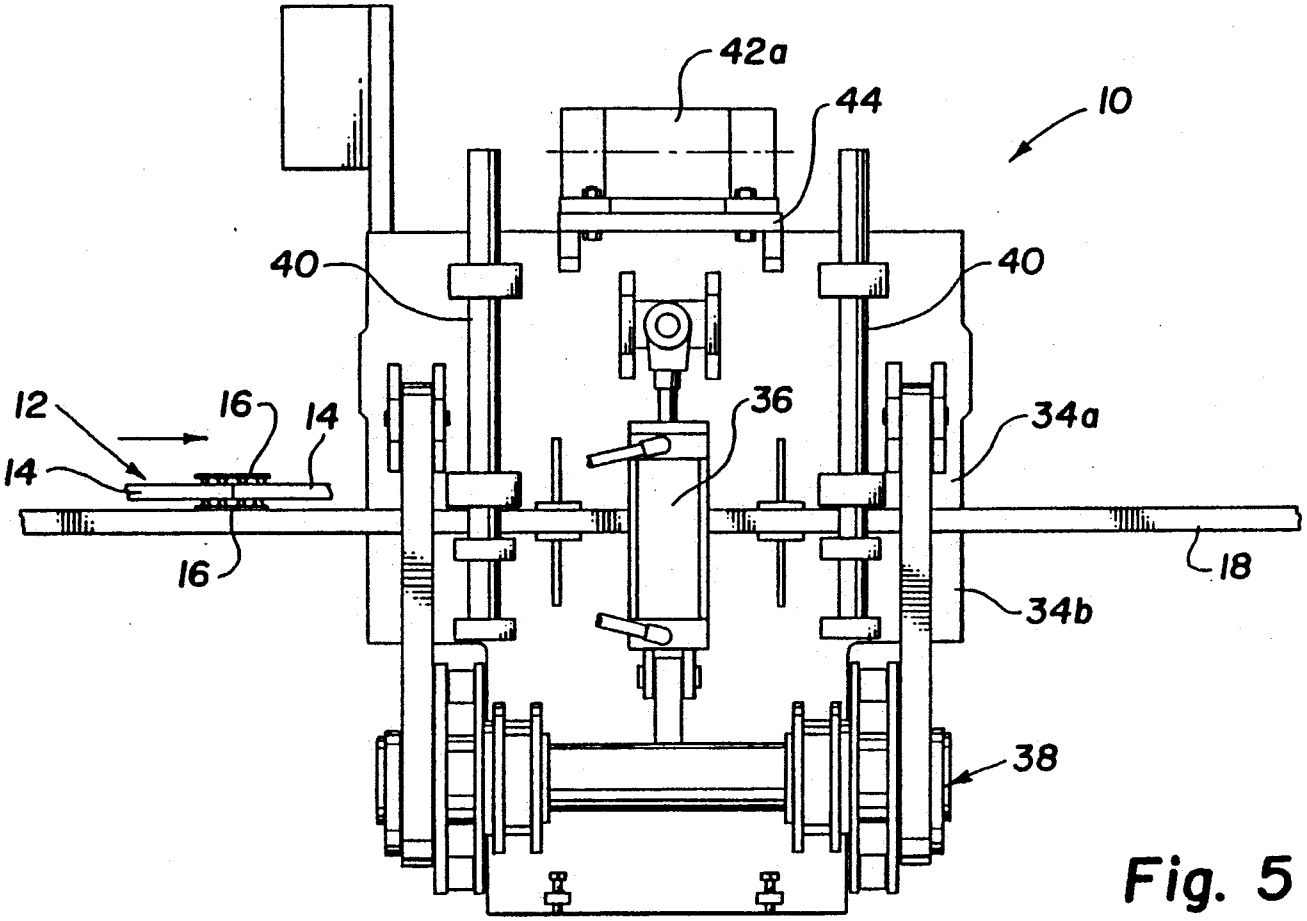
FIG. 5 is a side elevation view of the apparatus illustrated in FIG. 1.

The details of the illustrated connector plate seating apparatus 20 are shown in FIG. 5. The upper press plate 34A and lower press plate 34B comprise elongated, rigid members of a sufficient length to span the minimum dimension of the truss as shown in FIG. 1. Hydraulic cylinder 36 is mechanically connected between the press plates 34A and 34B at each end thereof. The two hydraulic cylinders can be used to move the press plates 34A and B between the compressed and retracted positions. Plates 34A and 34B have opposed flat press surfaces 35A and 35B, respectively, for contacting the truss parts.

A source of pressurized hydraulic fluid and appropriate control means (not shown) are connected in a manner well known in the industry to operate the hydraulic cylinders as required. Although hydraulic cylinders are preferred, other means of powering the press can be used. Suitable mechanisms 38 are utilized to mechanically interconnect the ends of the plates 34A and B so that the pressing faces thereof will move in a uniform manner to remain approximately parallel. In addition guides 40 can be provided to maintain alignment of the plates 34A and B. In the embodiment shown the guides 40 consist of rods connected to one plate which are guided by, and slide in sleeves connected to the other plate.

According to the present invention it has been found that by applying vibration forces during the seating of the connector plates that the resulting truss will be better and can be formed easier. Vibration forces are impact forces which are repeated rapidly. According to the present invention these vibration forces are preferably applied by two vibrator assemblies 42A and B. It is anticipated that more or less vibrator means could be used. In the embodiment shown in FIG. 1, the vibrator assemblies 42A and 34B are rigidly attached to press plate 34A by mounting brackets 44. As used herein, "vibrator or vibrator means" is used generically to include all devices for applying reciprocal impact forces. Although vibrator assemblies 42 are shown for purposes of description as being preferably mounted on the plate 34A, it is to be appreciated that the vibrators could be mounted on the 34B or, table 18 in fact, on one or more of plates 34A and B and table 18. It is also to be appreciated that the method of mounting the vibrator assemblies onto the plates is not essential, it only being important that the vibrators be mounted to impart vibration forces during the truss manufacturing process.

The connector plate seating apparatus illustrated in the embodiment of FIGS. 1 through 6 is a Gang-Nail Model E Compress System marketed by Mitek Industries, Earth City, Mo. In the illustrated embodiment the vibrators attached to the press are electrically powered vibrators manufactured by Global Electric Vibrators of Little Rock, Ark. In the illustrated embodiment Global Model Nos. 3501 and 5000 have been used. These models are electrically powered to rotate at 3600 rpm. These vibrators generate impact forces as high as 5000 lbs. per cycle. It is anticipated other vibrators powered by sources other than electricity could be used, such as, pneumatic or hydraulic. It is anticipated that vibrators in the range of about 500 to about 150,000 cps could be used with reciprocal impact forces as high as necessary.

Figure 7:
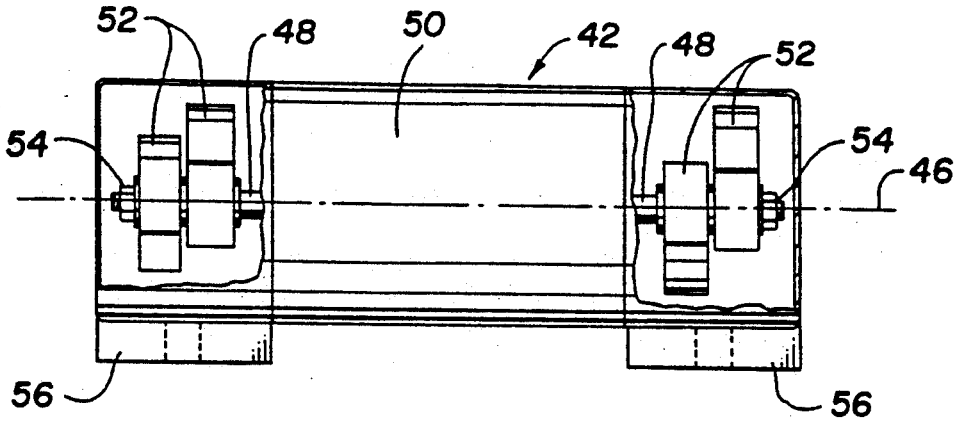
FIG. 7 is a partial sectional view of a portion of the apparatus shown in FIG. 1.

The typical details of the vibrators 42 are shown in FIG. 7. Each vibrator 42 has an axis of rotation 46 on which shaft 48 rotates. The axes 46 of the vibrator 42 are positioned in a parallel spaced relationship. Shaft 48 extends from and is driven by the armature of an electric motor 50. Attached at each end of the shaft 48 are eccentric weights 52. In some vibrators, weights 52 are held in place on keyed shafts by bolts 54. By using two weights 52 on each end and by using a keyed shaft the eccentricity of the weights can be adjusted by mounting the weights 52 in or out of alignment with each other. In this manner the vibration forces generated by the vibrator 42 can be adjusted to an effective amount for a given plate and environment. To determine the effective amount of vibration forces, the impact forces are raised from a minimum level until the connector plate will properly seat without damaging the connector or apparatus. It is believed that at higher frequencies greater impact forces can be used without damaging the connector plate. A pair of mounting brackets 56 are connected to the vibrator 42 for use in connecting the vibrator to the connector plate seating apparatus 20.

Figure 6:
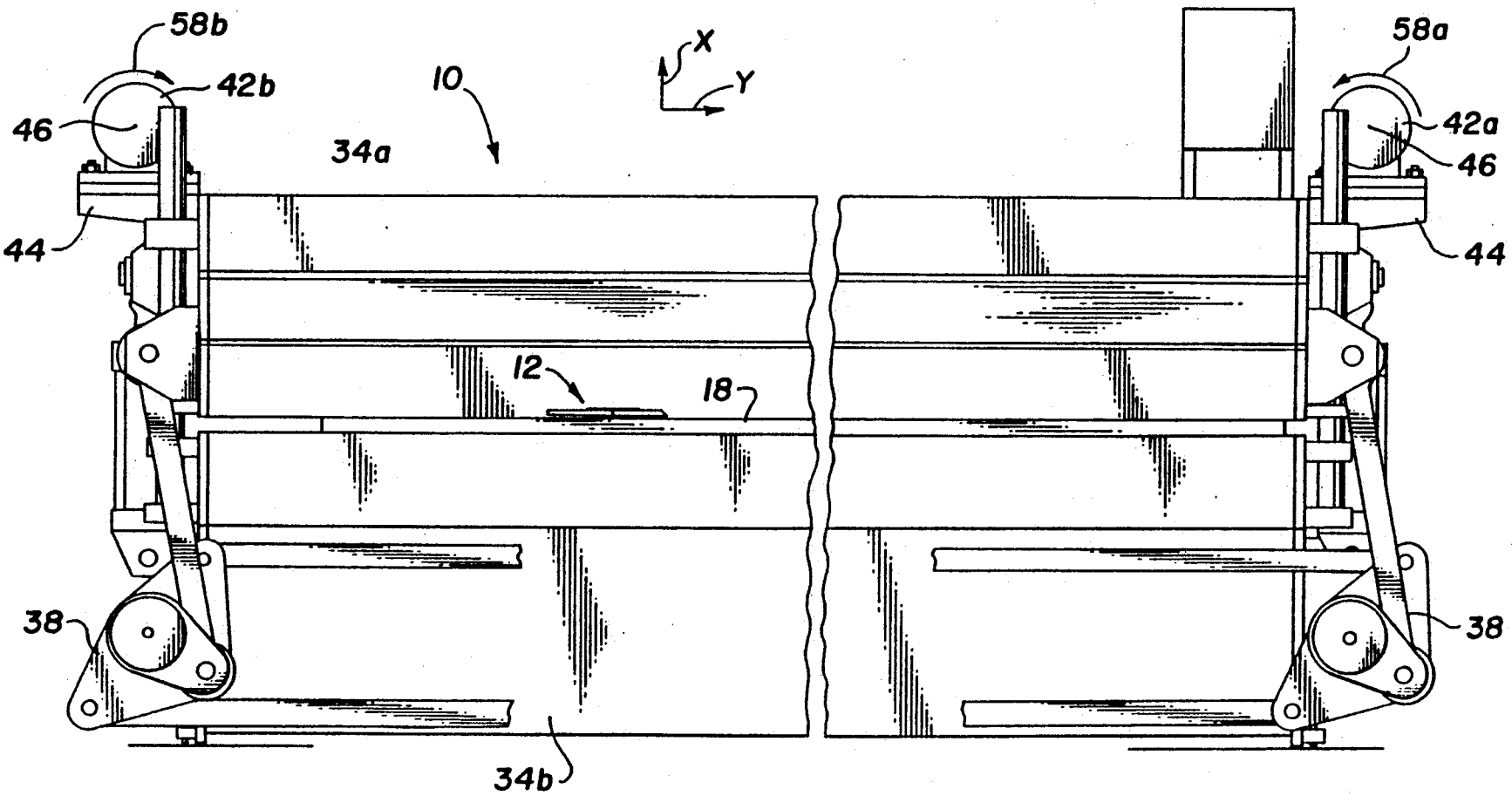
FIG. 6 is a front elevation view of the apparatus illustrated in FIG. 1.

According to a preferred feature of the present invention two vibrators are mounted on opposite ends of the plate 34A. The motors 50 of vibrators 42A and B are wired to rotate in opposite directions as shown by the arrows 58A and B in FIG. 6. It has been found that even though the armatures of the vibrators 42A and B are not mechanically connected, that during steady state operation the vibrators will rotate in phase with each other. Thus the vibrators will tend to work in tandem in the forward and reverse direction of arrow X and will cancel each other out in the direction of arrow "Y" as shown in FIG. 6.

In operation the vibrators 42 are operated during the seating of the connector plates 16 while the press plates 34A and B are being closed on the truss. It has been found that less force is required to properly seat the connector plate, that the connector plate will seat better in the wooden cords 14 and that the resulting truss is of better construction. It is believed that the vibratory forces result in a better connection between the protrusions 26 and the wood forming the cords 14. This may be due to the fact that the wood tends to open up to receive the protrusions of the connector plate 16 when vibratory forces are present.

Figure 8:
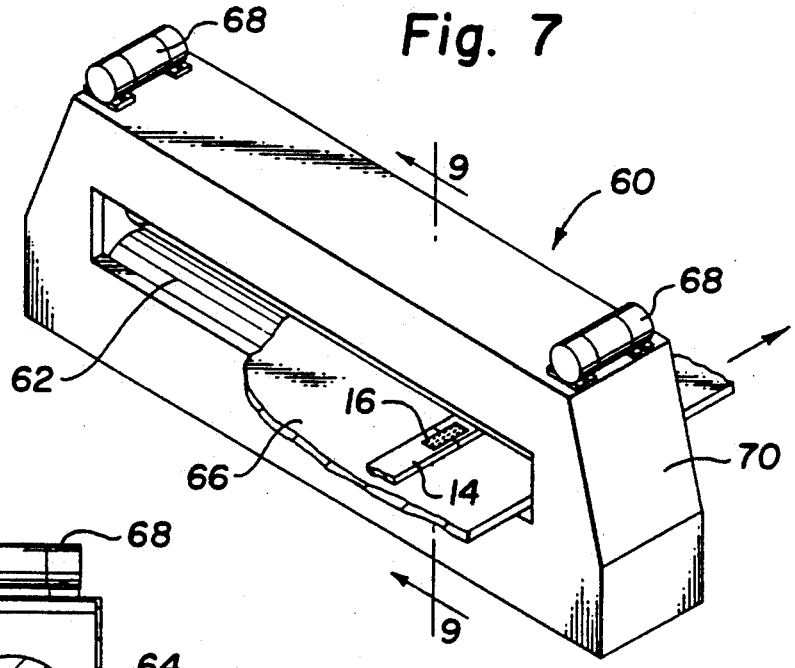
FIG. 8 is a perspective view of another embodiment of the present invention.
Figure 9:
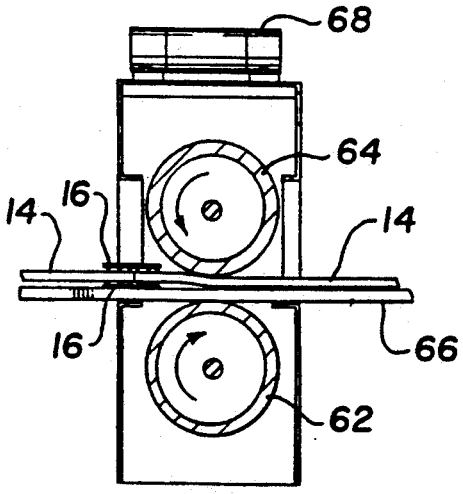
FIG. 9 is a sectional view taken on line 9—9 of FIG. 7 looking in the direction of the arrows.

It should be appreciated that the present invention has application to other types of connector plate seating apparatus. For example, in FIGS. 8 and 9 a roller-type connector plate seating apparatus 60 is shown. In a roller-type connector plate seating apparatus a pair of rollers 62 and 64 are driven to move a table 66 carrying a truss assembly. The rollers 62 and 64 press the connector plates 16 into the cords 14 as shown in FIG. 9. In this embodiment a pair of vibrator assemblies 68 are mounted on the frame 70 to apply vibratory forces during the connector plate seating operation. Vibrators 68 preferably rotate in opposite directions. The vibrators 68 could be mounted in the same manner as described with regard to the embodiment shown in FIG. 1. Vibrators 68 are operated while the connector plates are being seated between rollers 62 and 64. Effective impact forces are determined in the same manner as described previously.

Figure 10:
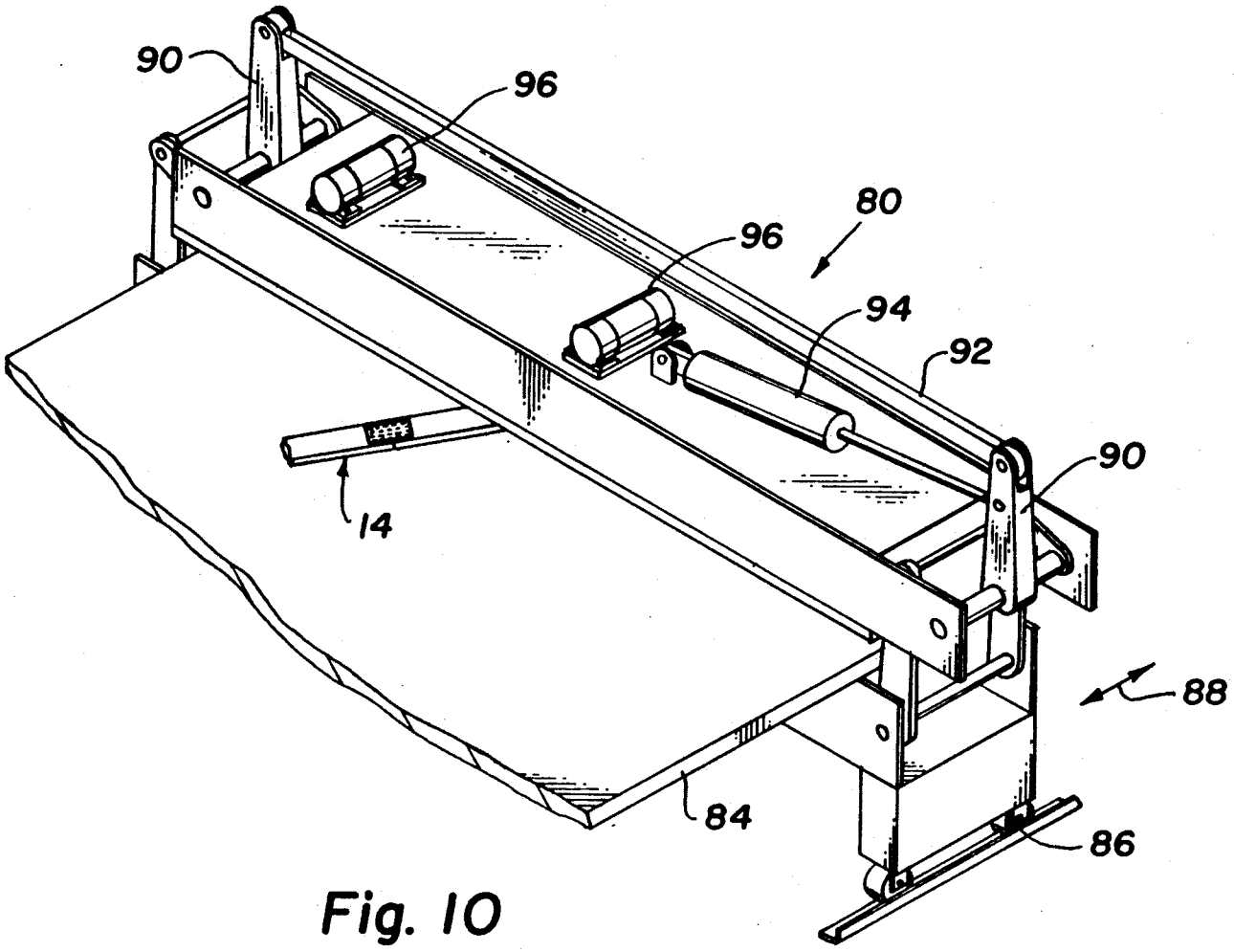
FIG. 10 is a perspective view of another embodiment of the present invention.
Figure 11:
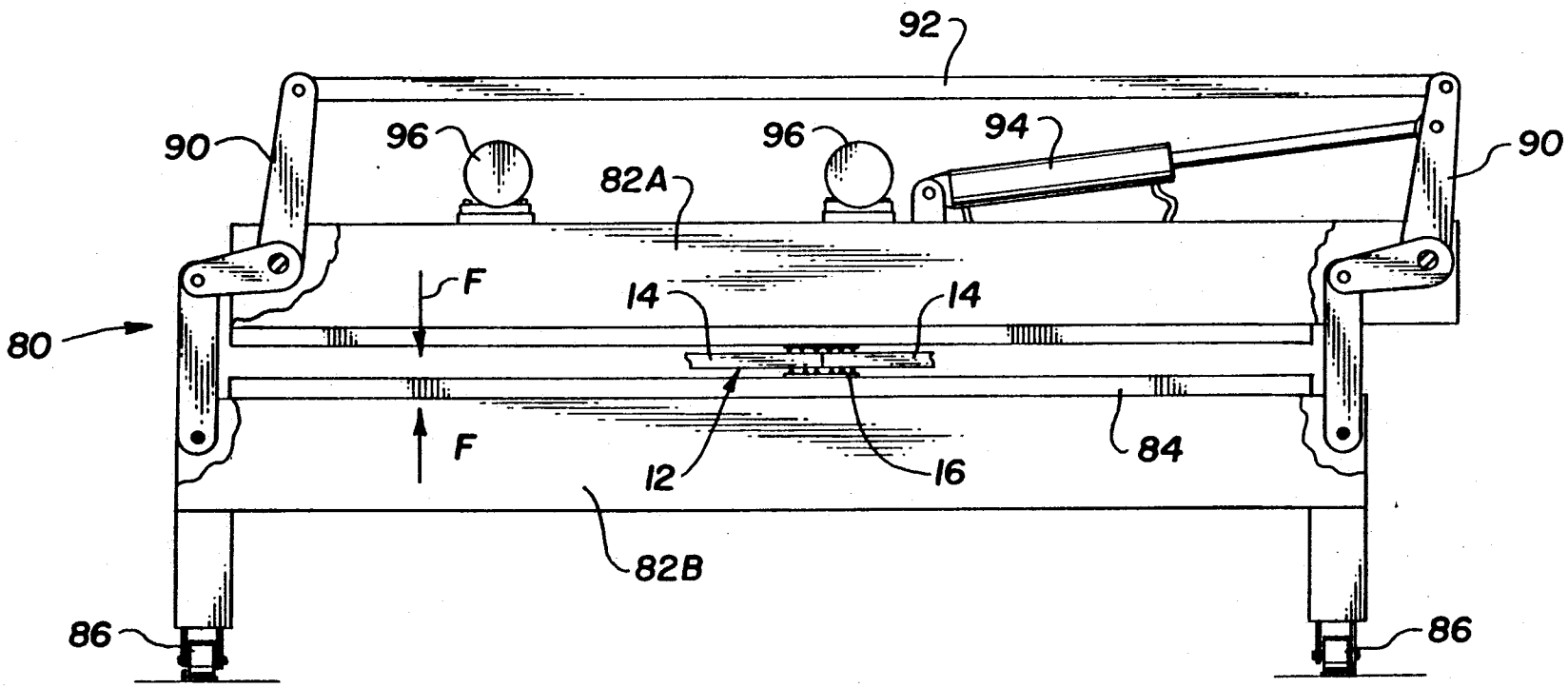
FIG. 11 is a sectional view taken on line 11—11, of FIG. 10 looking in the direction of the arrows.

In FIGS. 10 and 11 another embodiment of the present invention is shown. In FIG. 10, a press type connector plate seating apparatus 80 is shown. Apparatus 80 is similar in general construction to the apparatus illustrated in regard to FIG. 1 in that the apparatus has upper and lower press plates 82A and B of the table 84 extending between these plates. As with the embodiment of FIG. 1, a truss assembly 12 is placed on the table 84 and the press plates 82A and B are used to seat the connector plates 16 in the wooden cords 12 as previously described. Whereas the table was movable with regard to the embodiment of FIG. 1, the connector plate seating apparatus 80 moves with respect to the table. To accomplish this wheels 86 are mounted on legs located below the surface of table 84 to allow the apparatus 80 to be moved in the forward and reverse direction of the arrows 88 as shown in FIG. 10. As will be described in detail, a mechanism is provided on the plate seating apparatus 80 which can be utilized to move the press plates toward and away from each other in a manner to apply force as shown by Arrows "F" in FIG. 11 to truss 12 to cause the seating of the connector plate 16. Wheels 86 allow the apparatus 80 to be moved into position over the various connector plates present on a truss assembly. Truss plates 82A and B are connected together by a guide assembly (not shown) to eliminate body movement between the plates. A crank arm assembly 90 is pivotally connected between the upper plate 82A and the lower plate 82B. A connecting rod 92 is pivotally joined to the crank arm assembly 90 to coordinate the movement of the two crank arms. A double acting hydraulic cylinder 94 is pivotally connected between the right hand crank arm 90 and the upper press plate 82. Suitable hydraulic power source and controls are provided (not shown) to be utilized to actuate the cylinder through crank assembly 90 and connecting rod 92 will cause press plates 82A and B to reciprocate with respect to each other as previously described. According to a particular feature of the present invention a pair of vibrator assemblies 96 are attached to the upper plate member 82A shown in FIGS. 10 and 11. As with the embodiment of FIG. 1, these vibrators are of the type that utilize a rotating eccentric weight and their axes are positioned parallel with the direction of rotation being opposed. As seen in FIG. 11, the left hand vibrator 96 is arranged so that the direction of rotation is clockwise while the rightmost vibrator 96 as seen in FIG. 11 is arranged so that its axes of rotation is counterclockwise. The vibrators 96 are operated to provide vibration forces during seating of the plates 16 into the cords 14.

It is to be understood that even though numerous characteristics and advantages of the present invention have been set forth in the foregoing description, together with details of the structure and function of the invention, the disclosure is illustrative only, and changes may be made in the detail, especially in matters of shape, size and arrangement of the parts within the principles of the invention to the full extent indicated by the broad general meaning of the terms in which the appended claims are expressed.

I claim:

1. An apparatus for forming wooden trusses by embedding the protrusions of connector plates in wooden cords to assemble the wooden cords into trusses, comprising means for contacting and forcing the connector plate into the wooden cords to join wooden cords together to form a truss and vibrator means on said apparatus for applying vibration forces to the connector plate while said contacting and forcing means is forcing the connector plates into the wooden cords.

2. A method of forming wooden trusses by embedding the protrusions of connector plates in wooden cords to assemble the wooden cords into trusses, comprising the steps of positioning at least two wooden cords in an adjacent relationship, positioning at least one connector plate in a position overlapping said at least two wooden cords, forcing the protrusions of the connector plates into the wooden cords while simultaneously applying vibration forces to the connector plates.

* * * * *